US010977967B1

(12) United States Patent
Ekroth et al.

(10) Patent No.: US 10,977,967 B1
(45) Date of Patent: Apr. 13, 2021

(54) LARGE STRUCTURE DISPLAY SYSTEM

(71) Applicants: Chad Ekroth, Yankton, SD (US); Troy Fox, Madison, SD (US)

(72) Inventors: Chad Ekroth, Yankton, SD (US); Troy Fox, Madison, SD (US)

( * ) Notice: Subject to any disclaimer, the term of this patent is extended or adjusted under 35 U.S.C. 154(b) by 0 days.

(21) Appl. No.: 16/823,829

(22) Filed: Mar. 19, 2020

Related U.S. Application Data

(60) Provisional application No. 62/827,903, filed on Apr. 2, 2019.

(51) Int. Cl.

| | |
|---|---|
| ***G09F 15/00*** | (2006.01) |
| ***G09F 23/00*** | (2006.01) |
| ***G09F 7/20*** | (2006.01) |
| ***G09F 19/22*** | (2006.01) |

(52) U.S. Cl.
CPC ..... *G09F 15/0062* (2013.01); *G09F 7/20* (2013.01); *G09F 19/226* (2013.01); *G09F 23/00* (2013.01)

(58) Field of Classification Search
CPC ..... G09F 15/0062; G09F 7/20; G09F 19/226; G09F 23/00
See application file for complete search history.

(56) References Cited

U.S. PATENT DOCUMENTS 1,740,071 A * 12/1929 Coffey ..... G09F 19/22 40/446
4,292,751 A * 10/1981 Snyder, Jr. ..... G09F 11/29 40/517
4,514,725 A * 4/1985 Bristley ..... G08B 7/064 340/531
5,743,484 A * 4/1998 Baskett ..... B65H 16/00 242/557
5,815,966 A * 10/1998 Vestevich ..... G09F 15/0025 40/217
2002/0069566 A1* 6/2002 Netter ..... G09F 19/22 40/605
2005/0028943 A1* 2/2005 Chang ..... G09F 15/0062 160/23.1
2009/0128461 A1* 5/2009 Geldard ..... G09F 19/226 345/84
2010/0050489 A1* 3/2010 Merner ..... G09F 15/0025 40/604
2011/0209371 A1* 9/2011 Taylor ..... G09F 23/00 40/600
2012/0260547 A1* 10/2012 English ..... G09F 15/00 40/594
2013/0016497 A1* 1/2013 Anderson ..... G09F 9/301 362/97.1
2014/0268532 A1* 9/2014 Nicol ..... G09F 9/301 361/679.26
2016/0055776 A1* 2/2016 Lanzito ..... G09F 23/00 40/611.12

(Continued)

*Primary Examiner* — Gary C Hoge
(74) *Attorney, Agent, or Firm* — Jeffrey A. Proehl; Woods, Fuller, Shultz & Smith, PC

(57) ABSTRACT

A system for displaying information in a large scale format may include a structure extending upwardly from a ground surface and having an exterior surface, and a display apparatus mounted on the structure. The display apparatus may include a housing having an interior, and a display member mounted on the housing and being movable with respect to the housing between a retracted condition and an extended condition, the display member being formed of a sheet material.

20 Claims, 15 Drawing Sheets

(56) References Cited

U.S. PATENT DOCUMENTS

| | | | | |
|---|---|---|---|---|
| 2016/0104399 | A1* | 4/2016 | Gottschalk | G09F 15/0037 428/99 |
| 2017/0290175 | A1* | 10/2017 | Malik | G09F 15/0062 |

* cited by examiner

LARGE STRUCTURE DISPLAY SYSTEM

REFERENCE TO RELATED APPLICATION

This application claims the benefit of the priority of U.S. Provisional Patent Application No. 62/827,903, filed Apr. 2, 2019, which is hereby incorporated by reference in its entirety.

BACKGROUND

Field

The present disclosure relates to signage and more particularly pertains to a new large structure display system for providing information in a large format on existing structures often not utilized as an advertising platform.

SUMMARY

The present disclosure relates to a system for displaying information in a large scale format. The system may comprise a structure extending upwardly with respect to a ground surface and the structure may have an exterior surface. The system may also include a display apparatus mounted on the structure, and the display apparatus may comprise a housing having an interior and a display member mounted on the housing and being movable with respect to the housing between a retracted condition and an extended condition. The display member may be formed of a sheet material with markings on the sheet material, the markings being visible when the display member is in the extended condition on the structure and being hidden when the display member is in the retracted condition.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
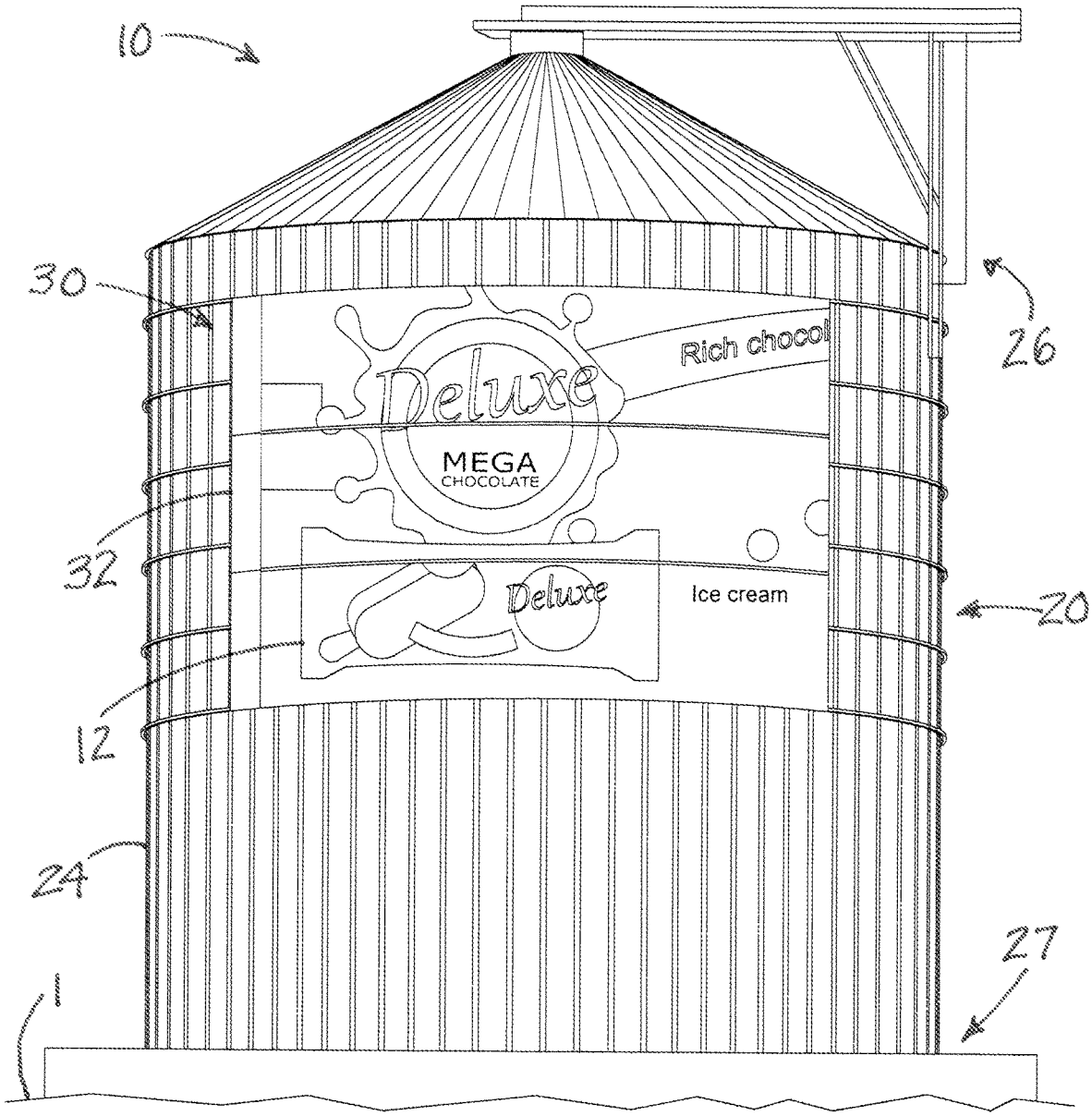
FIG. 1 is a schematic side view of a large structure display system including a structure and a display apparatus on the structure according to the present disclosure.
Figure 2:
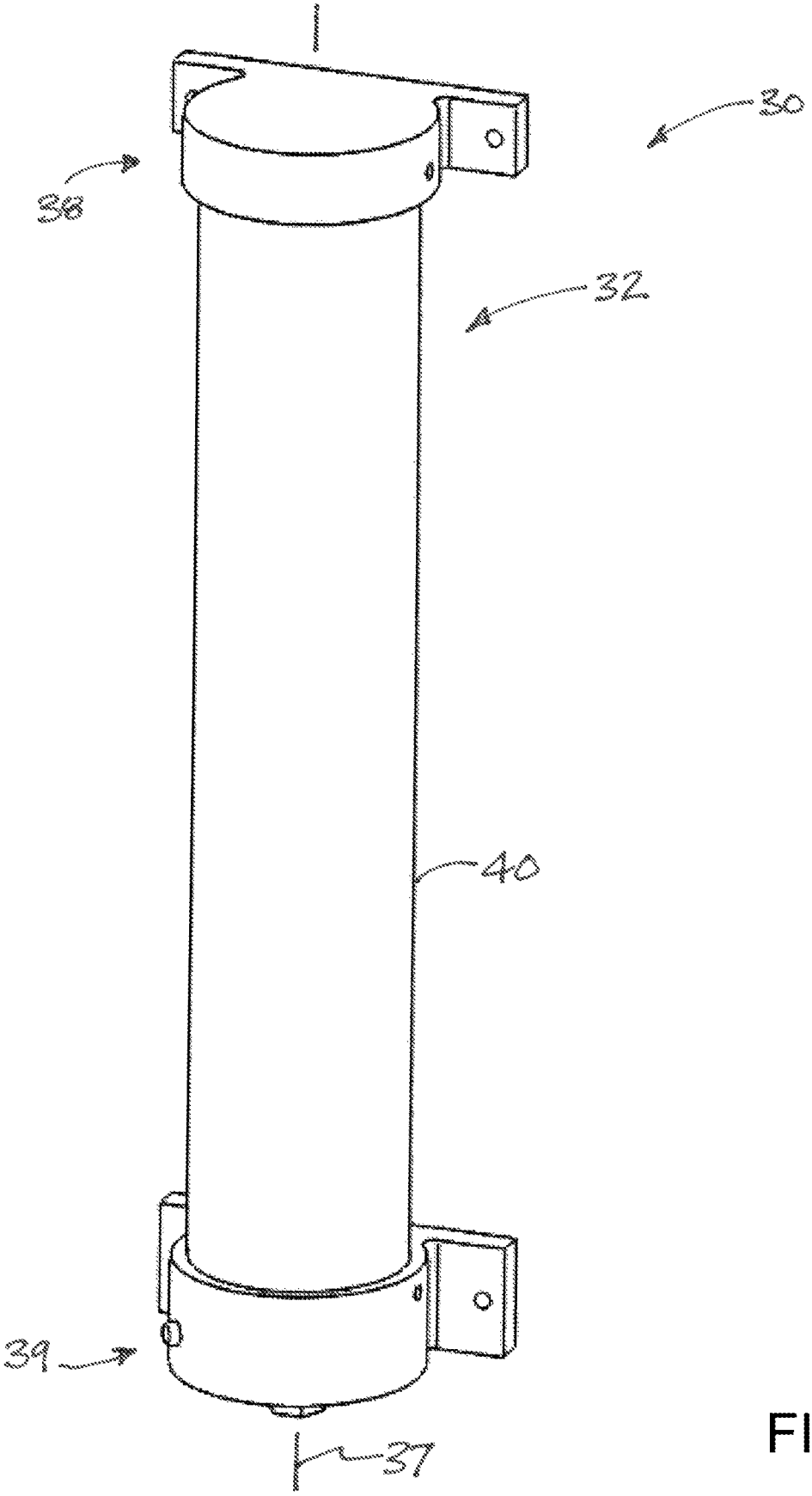
FIG. 2 is a schematic front perspective view of the housing of the display apparatus, according to an illustrative embodiment.
Figure 3:
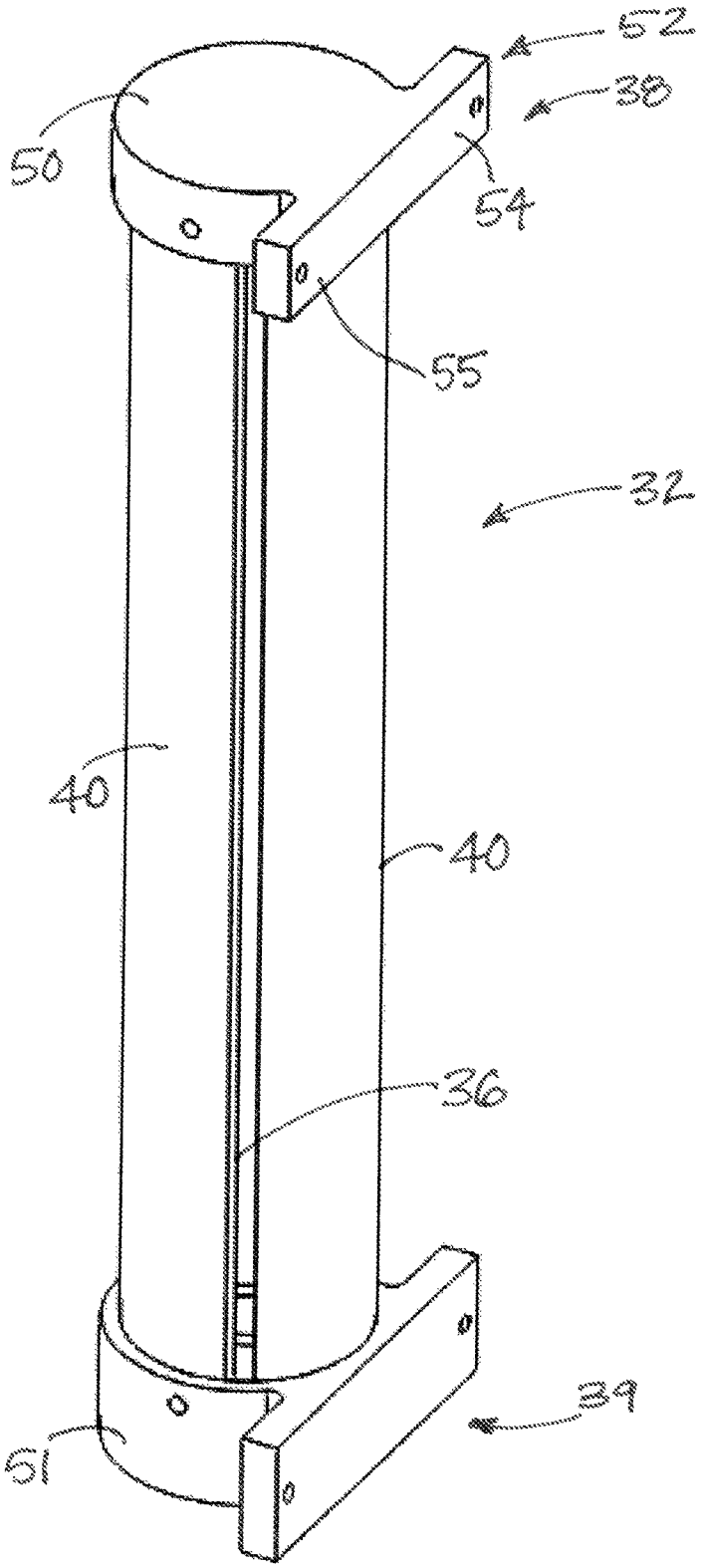
FIG. 3 is a schematic rear perspective view of the housing of the display apparatus, according to an illustrative embodiment.
Figure 4:
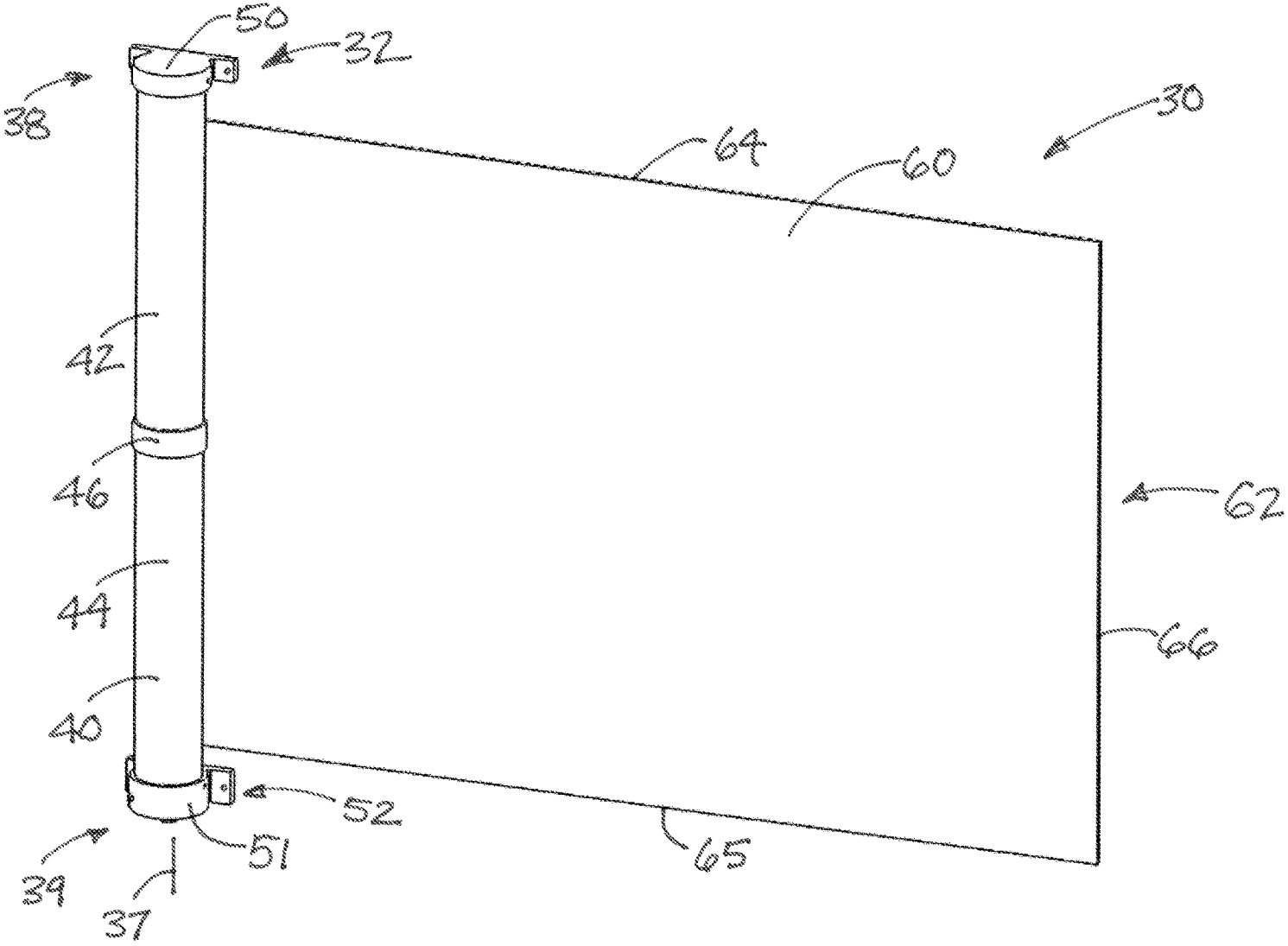
FIG. 4 is a schematic perspective view of the display apparatus with the display member in the extended condition from the housing, according to an illustrative embodiment.
Figure 5:
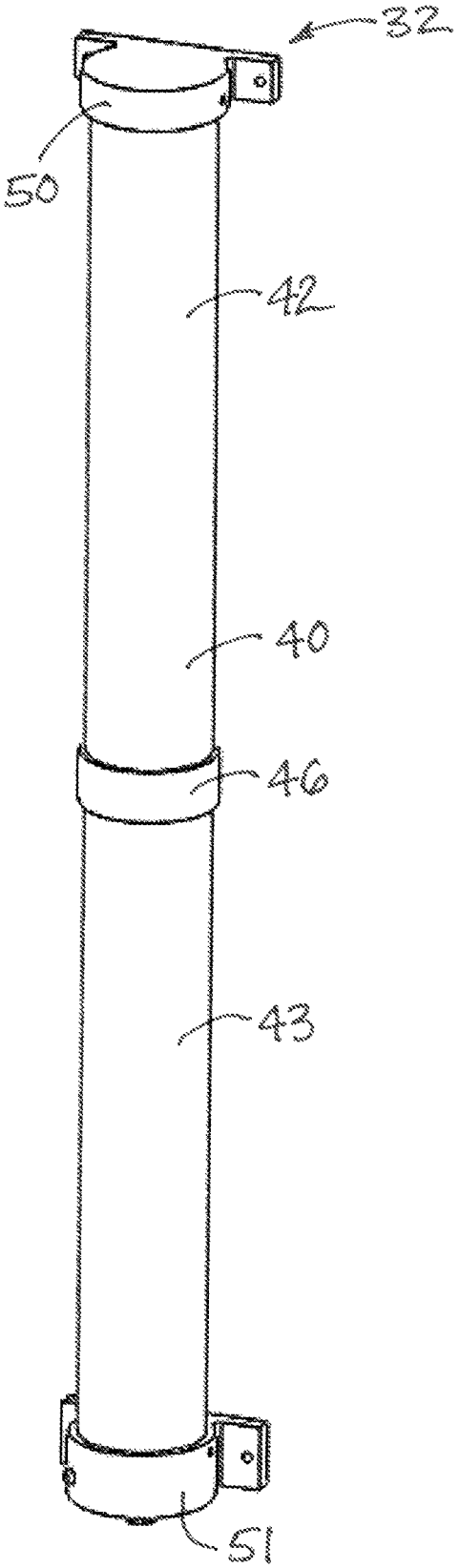
FIG. 5 is a schematic perspective view of the housing of the display apparatus utilizing two sleeve portions, according to an illustrative embodiment.
Figure 6:
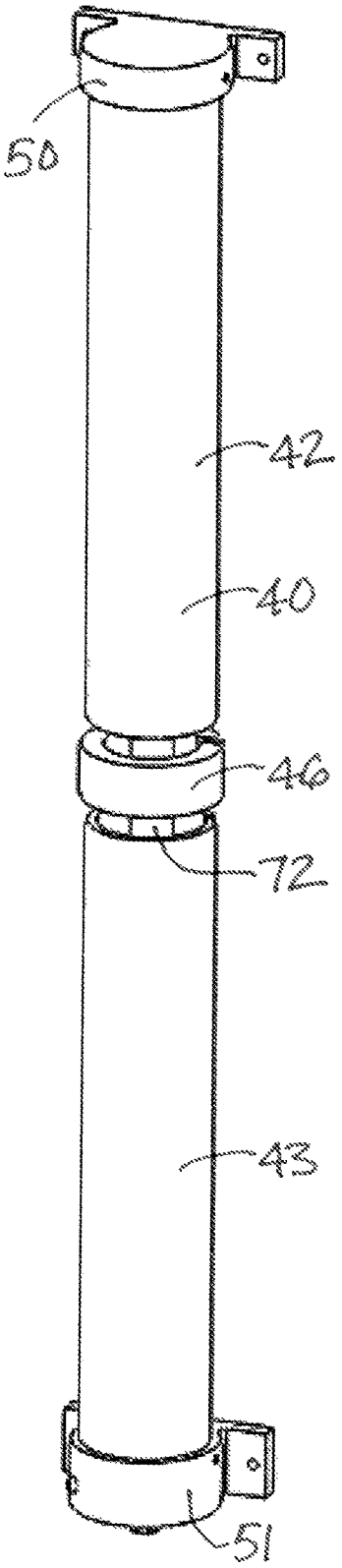
FIG. 6 is a schematic partially exploded perspective view of the housing of the display apparatus utilizing two sleeve portions, according to an illustrative embodiment.
Figure 7:
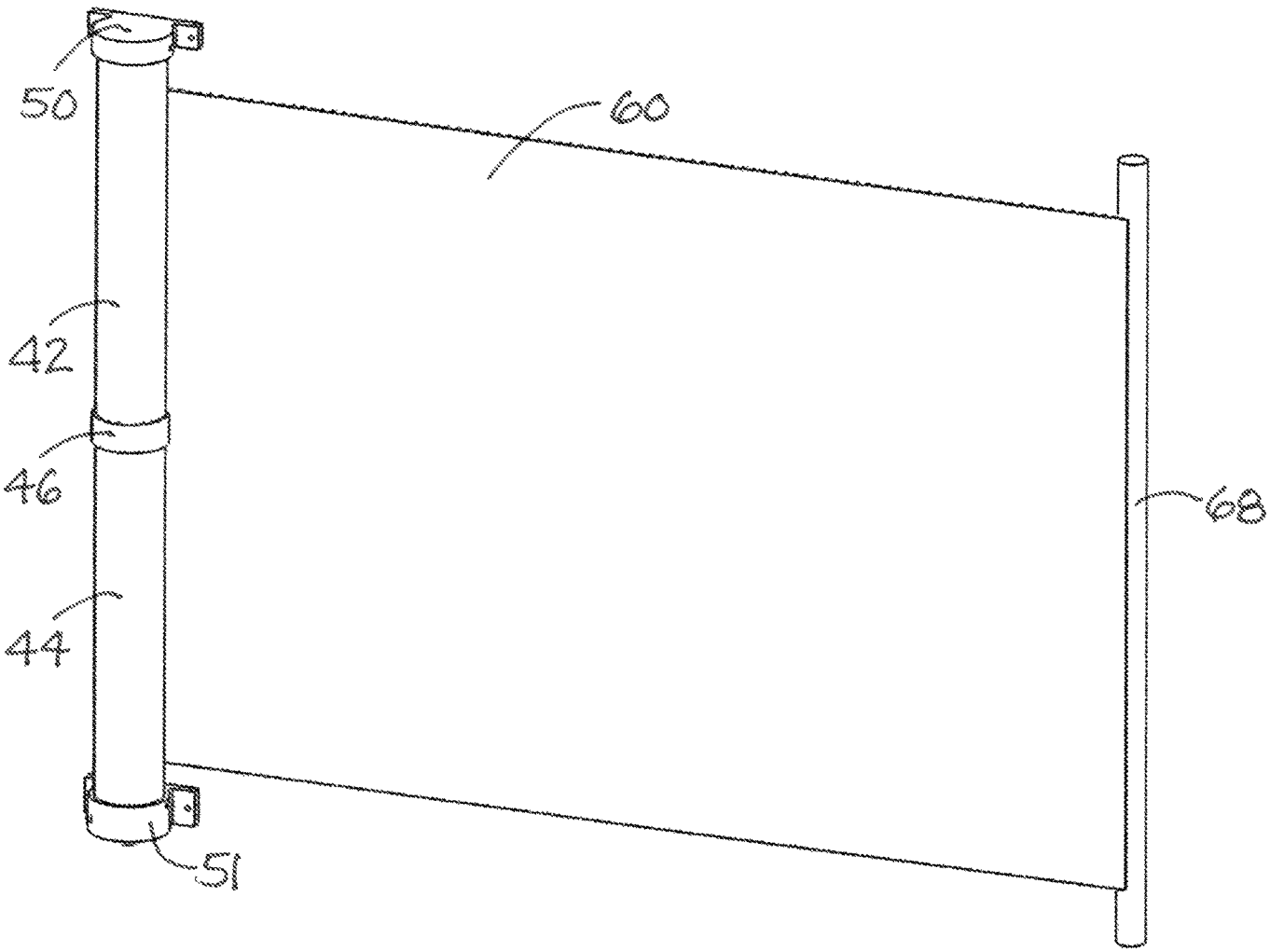
FIG. 7 is a schematic perspective view of the display apparatus with the display member in the extended condition from the housing utilizing multiple sleeve portions, according to an illustrative embodiment.
Figure 8:
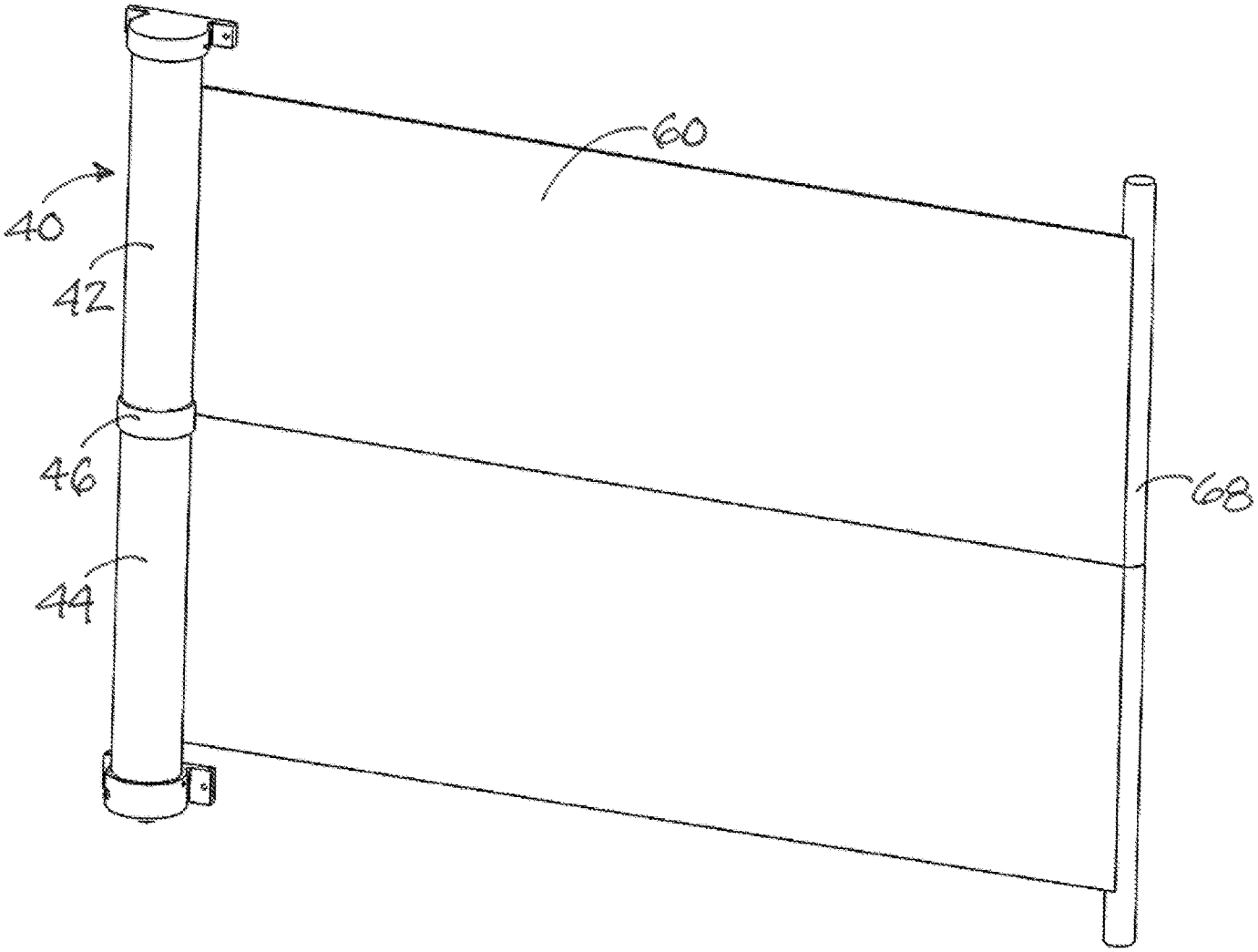
FIG. 8 is a schematic perspective view of the display apparatus with the display member having multiple portions in the extended condition from the housing utilizing multiple sleeve portions, according to an illustrative embodiment.
Figure 9:
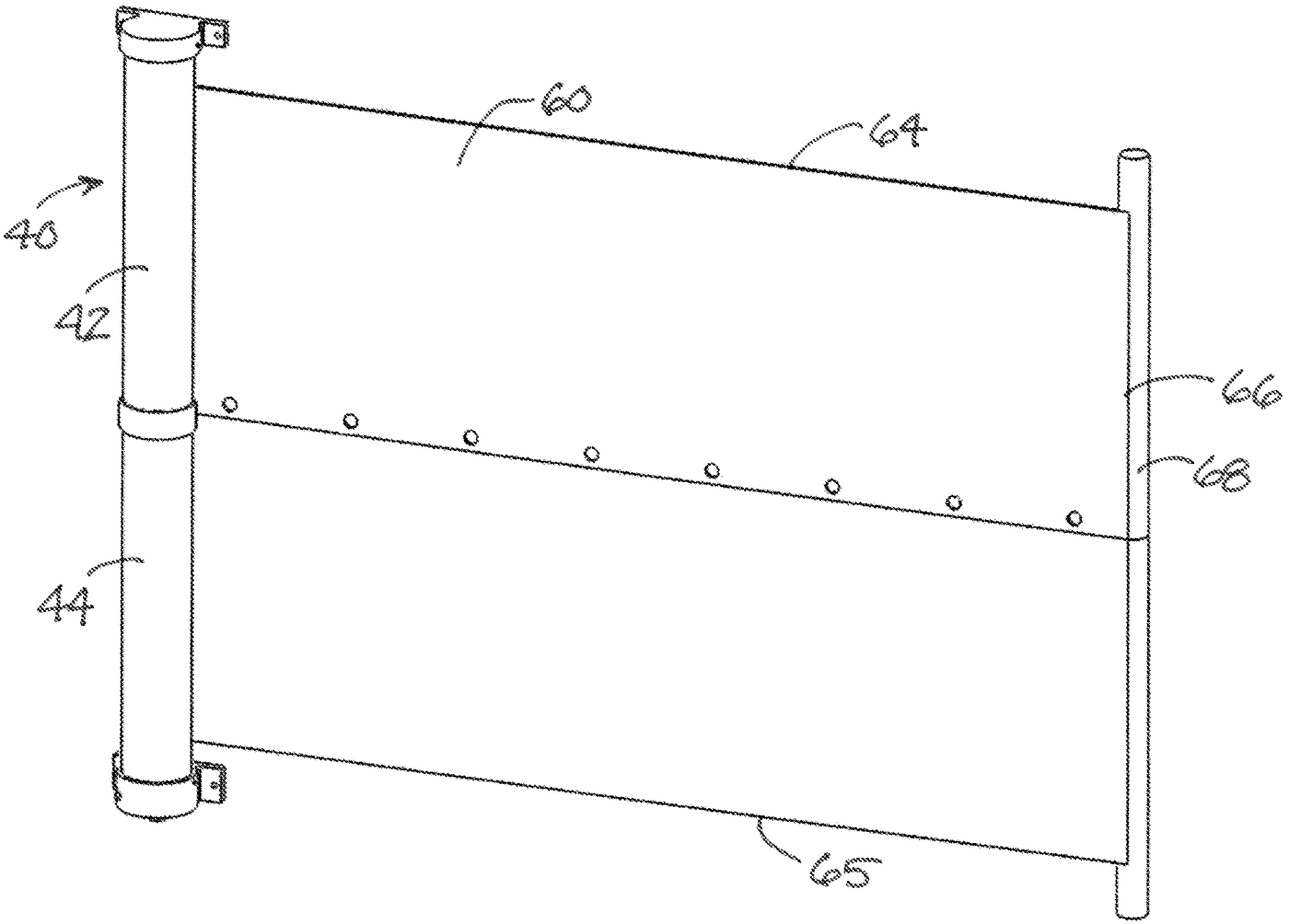
FIG. 9 is a schematic perspective view of another configuration of the display apparatus with the display member having multiple portions in the extended condition from the housing utilizing multiple sleeve portions, according to an illustrative embodiment.
Figure 10:
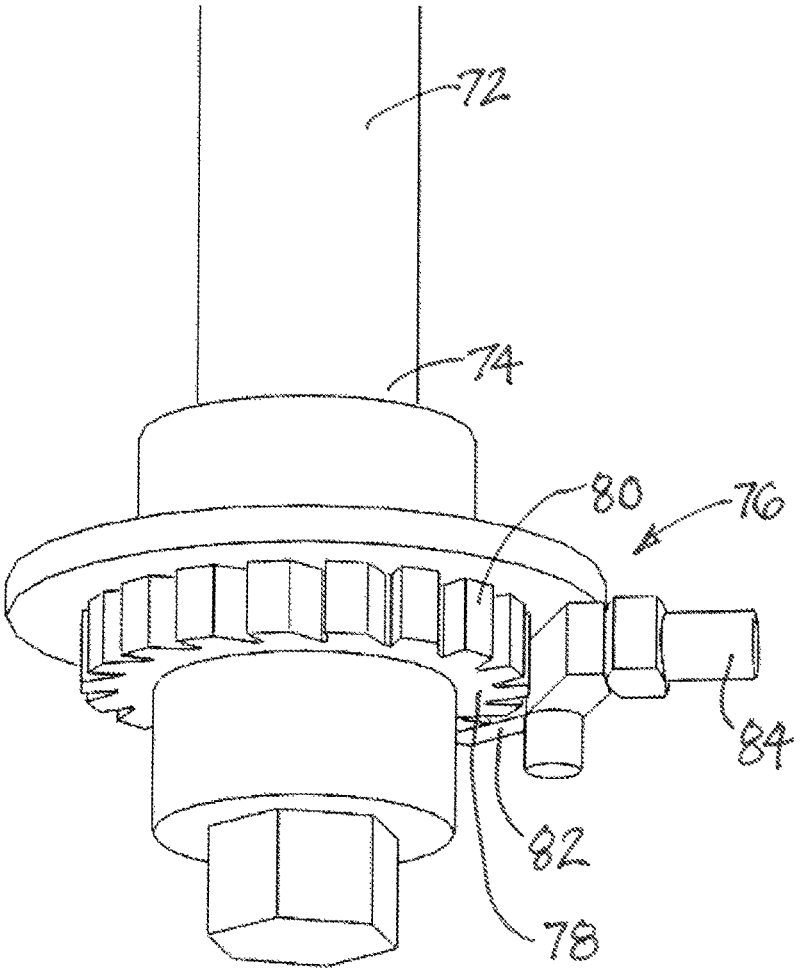
FIG. 10 is a schematic perspective view of a portion of the support shaft and elements of the ratchet apparatus of the support assembly, according to an illustrative embodiment.
Figure 11:
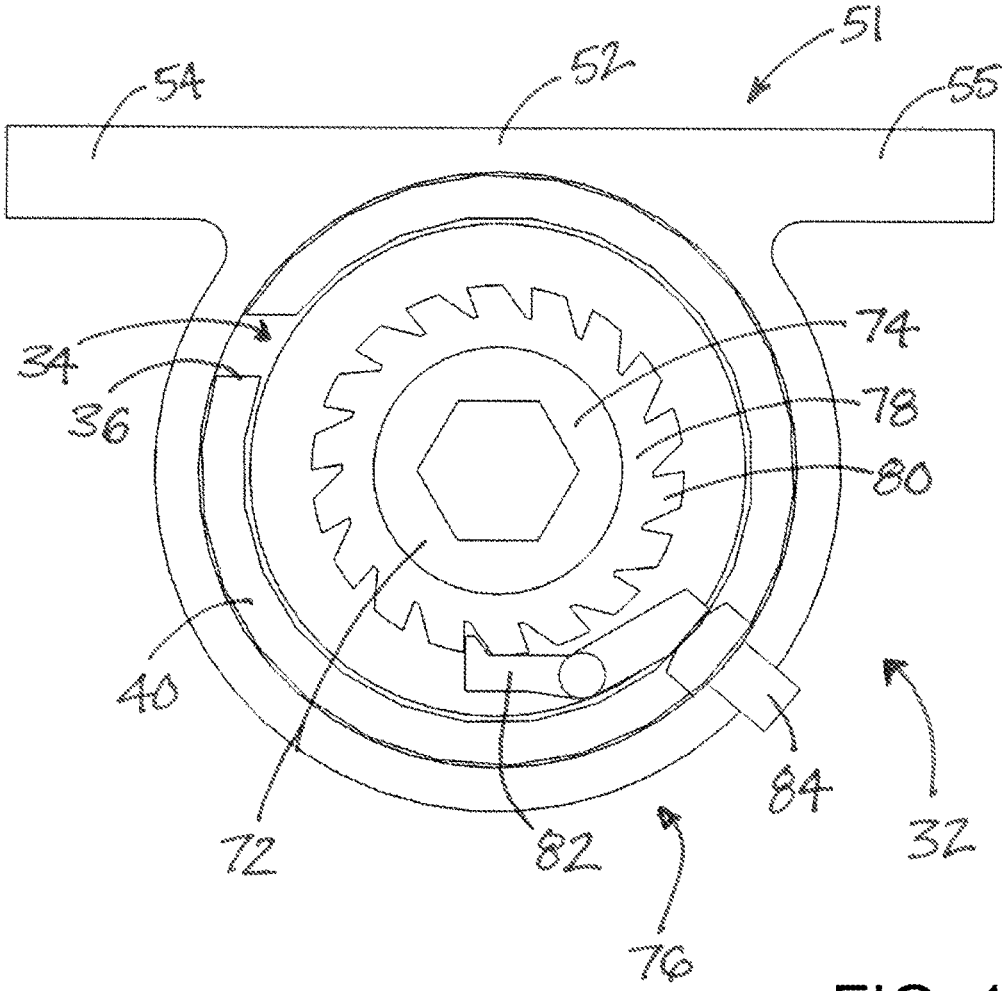
FIG. 11 is a schematic end view of the housing and ratchet apparatus of the support assembly of the display apparatus, according to an illustrative embodiment.
Figure 12:
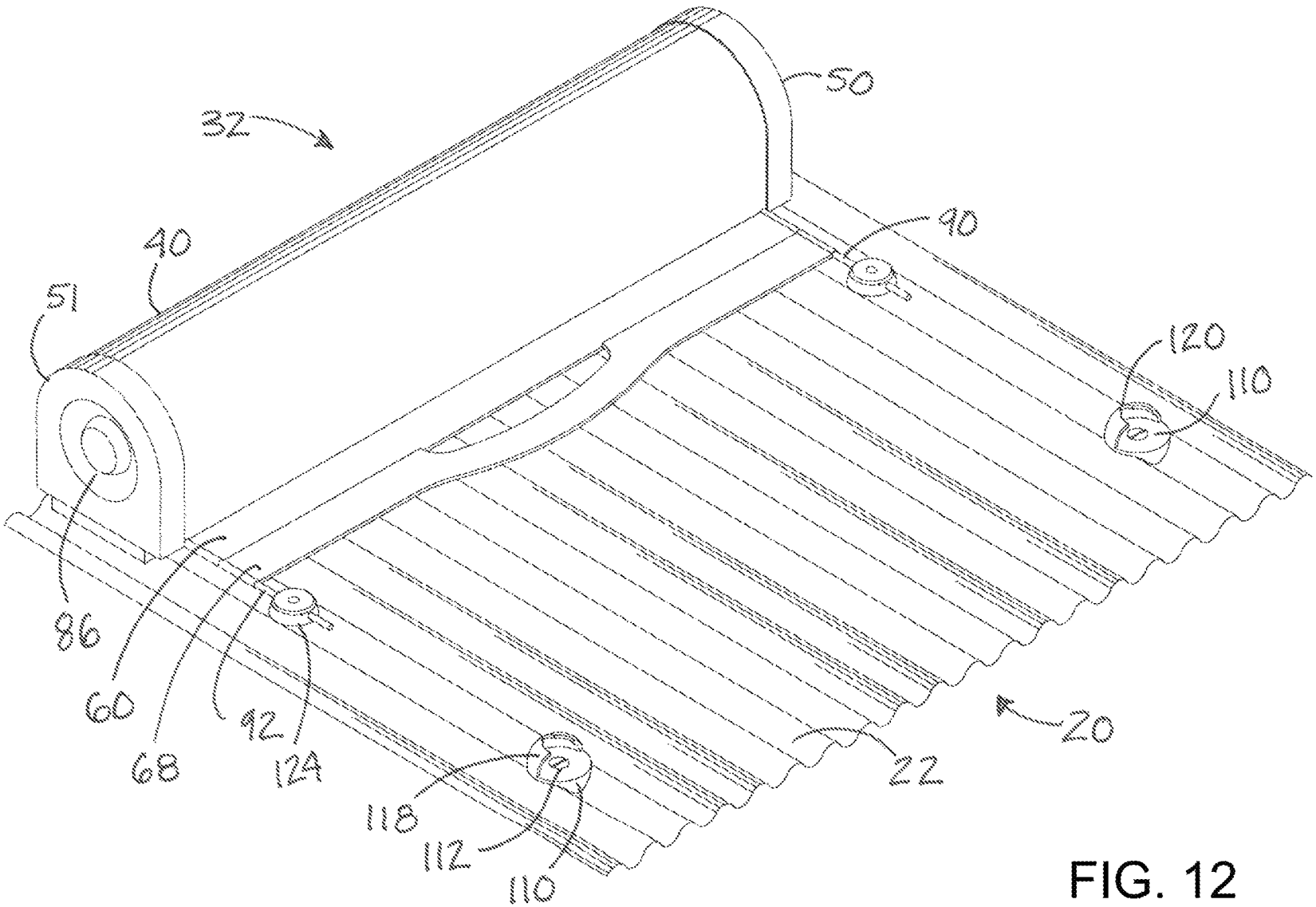
FIG. 12 is a schematic perspective view of elements of the display apparatus shown mounted on a structure, according to an illustrative embodiment.
Figure 13:
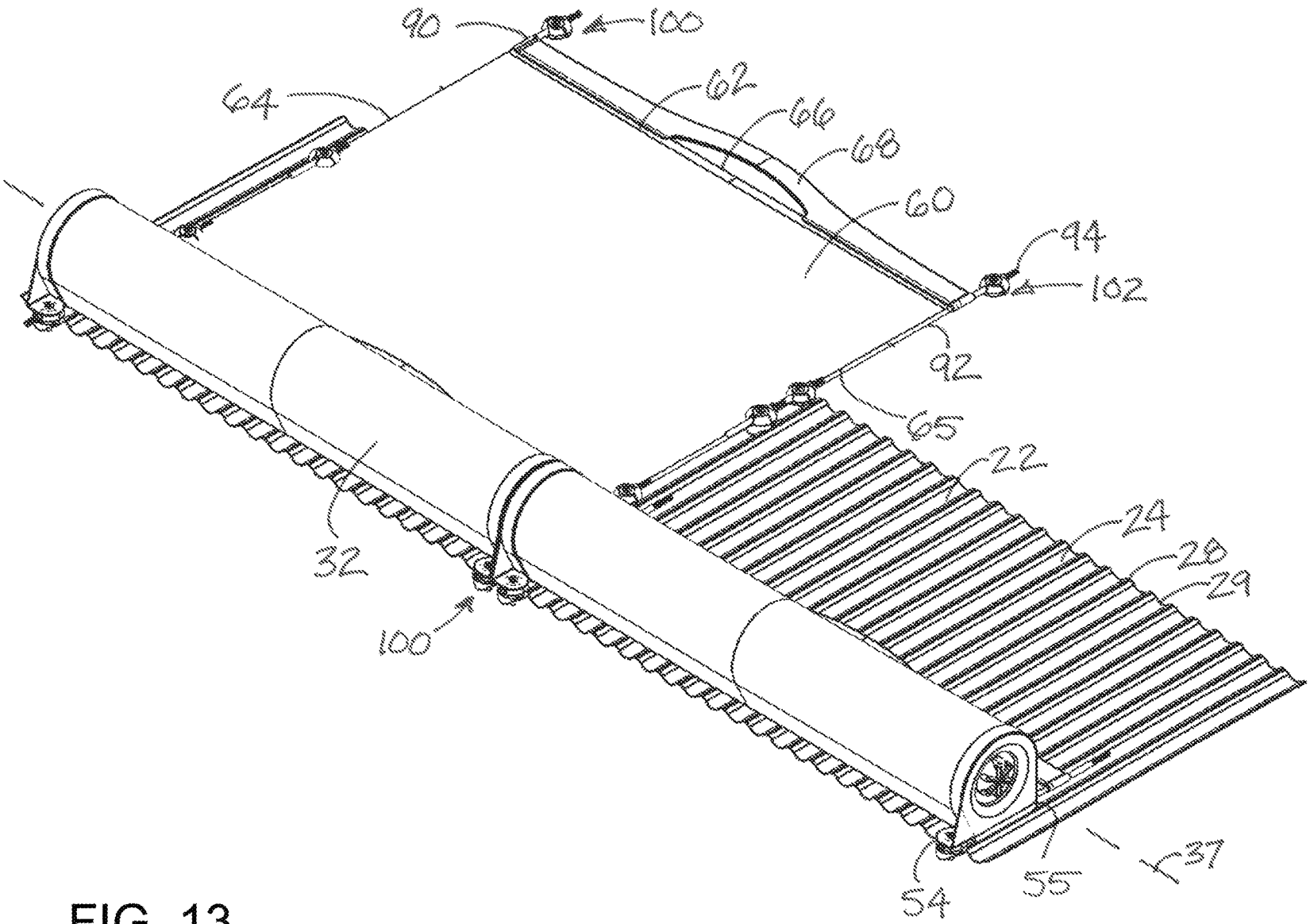
FIG. 13 is a schematic perspective view of the display apparatus shown installed on a broken away portion of the structure, according to an illustrative embodiment.
Figure 14:
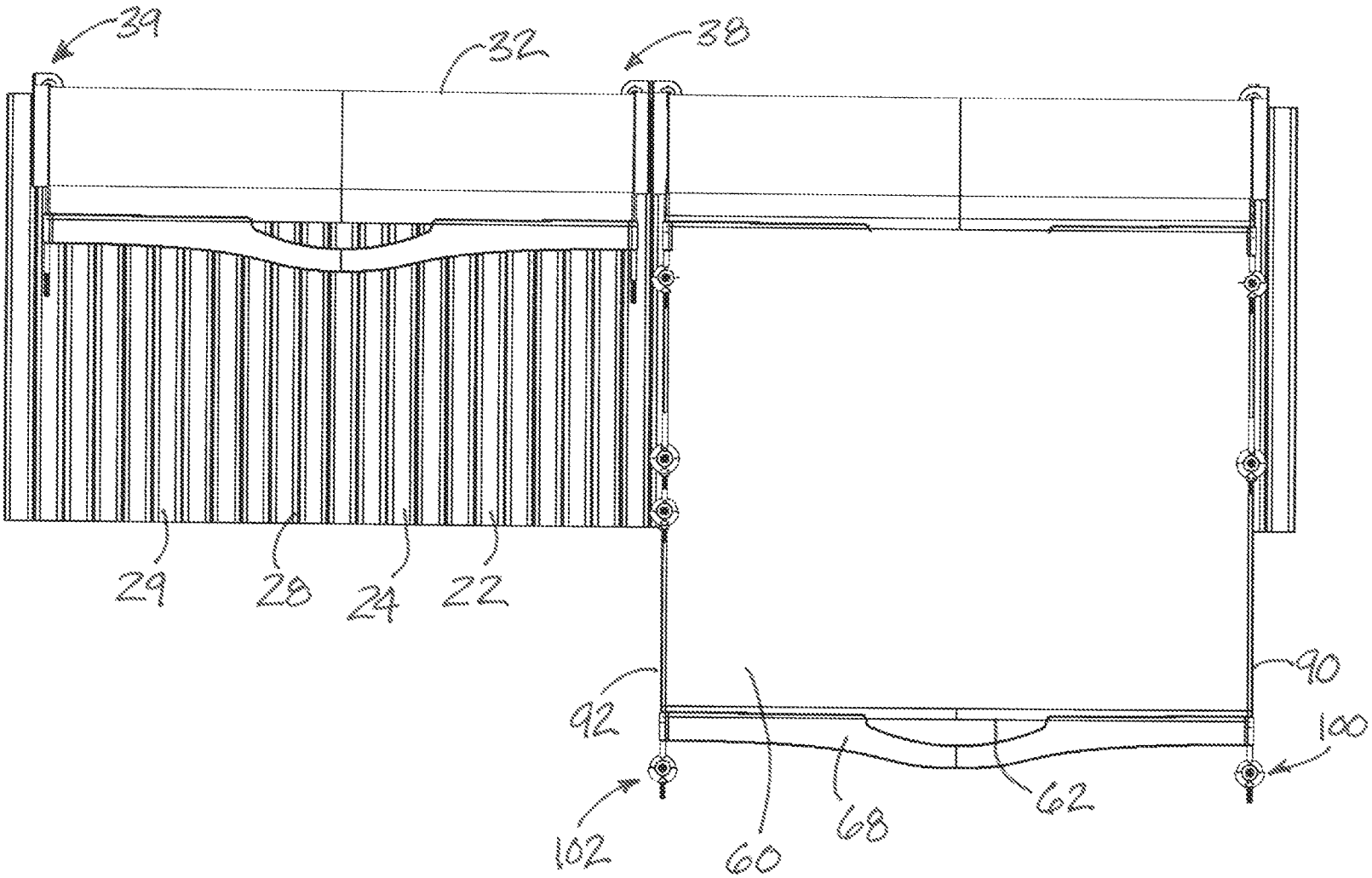
FIG. 14 is a schematic top view of the display apparatus shown installed on a broken away portion of the structure, according to an illustrative embodiment.
Figure 15:
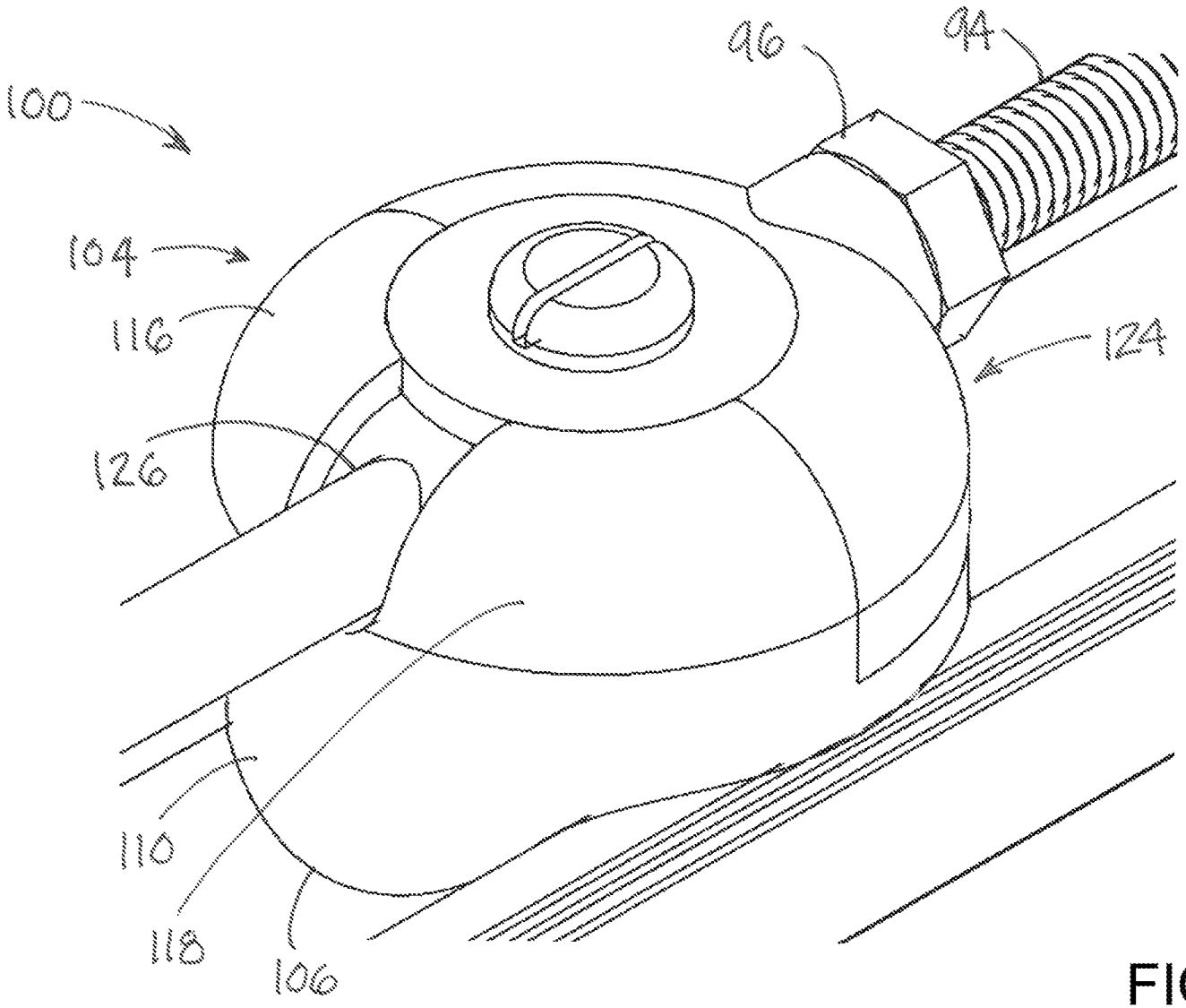
FIG. 15 is a schematic perspective view of a support element of the display apparatus shown securing a support strand to a structure, according to an illustrative embodiment.
Figure 16:
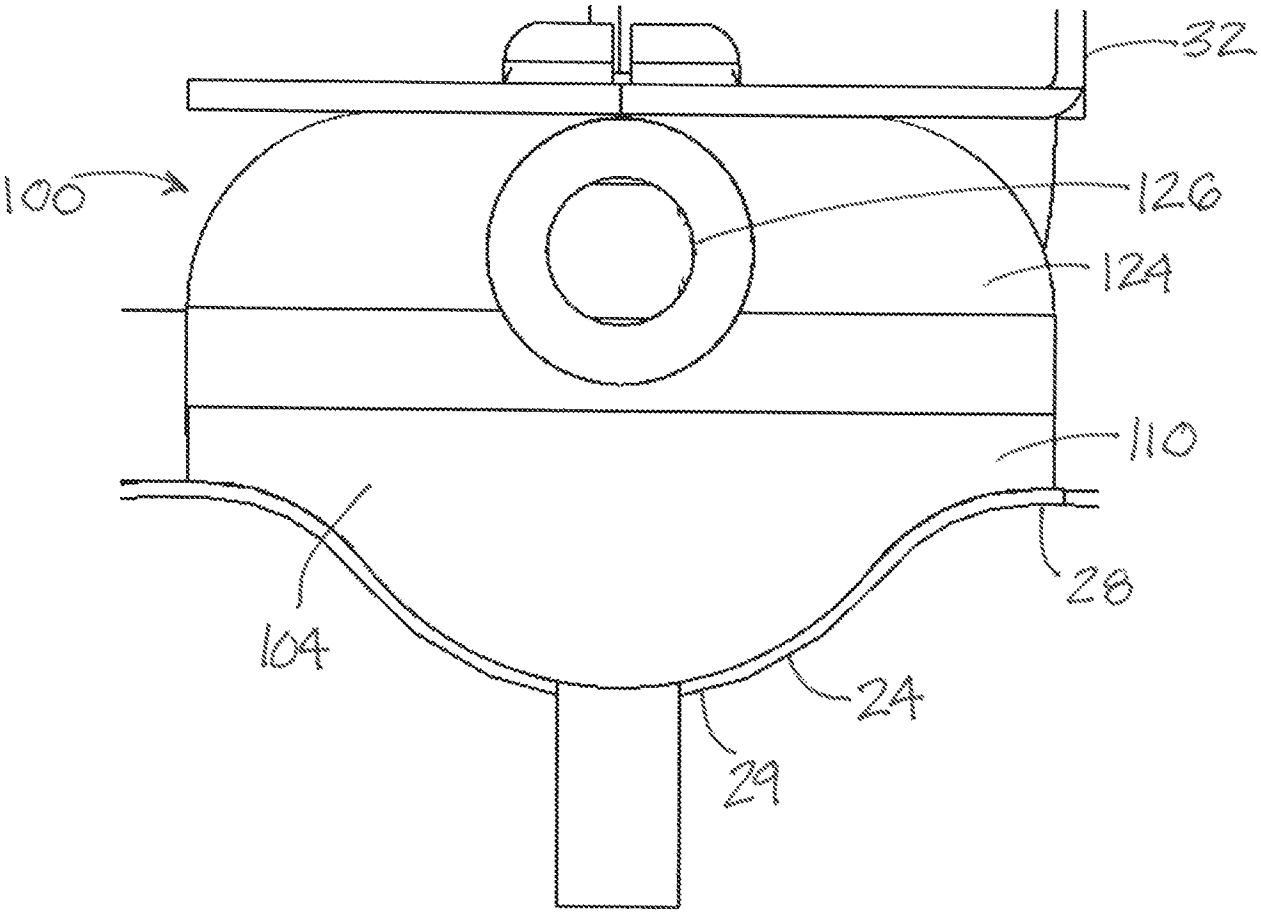
FIG. 16 is a schematic perspective view of a support element of the display apparatus shown securing a broken away portion of the housing of the display apparatus to a structure, according to an illustrative embodiment

With reference now to the drawings, and in particular to FIGS. 1 through 16 thereof, a new large structure display system embodying the principles and concepts of the disclosed subject matter will be described.

Large portions of the country are rural devoid of many of the structures that populate urban areas, but do tend to include a multitude of large structures typically having agricultural purposes. The applicants have recognized that the large structures offer a platform for conveying information to individuals, such as travelers in vehicles moving down rural highways. In addition to their normal agricultural functionality, these large structures have the potential to be used as a platform for displaying information to people traveling in vehicles along those roads. Such venues do present a challenge in the exposure to environmental elements not present in many conventional advertising spaces.

One aspect of the disclosure relates to a system 10 for displaying information 12 in a large scale format, such as a structure 20 which may extend upwardly with respect to the ground surface 1. In some implementations of the system, the structure may comprise an agricultural structure, and such agricultural structures may comprise storage bins or silos for storing materials such as harvested grains or silage. Suitable structures 20 may have an exterior surface 22 which in turn may be formed by a perimeter wall 24 of the structure. In some applications, and in particular bins and silos, the exterior surface 22 may have a substantially cylindrical shape and may be elongated upwardly with a top 26 and a bottom 27 located at the ground surface. The exterior surface of the perimeter wall of such structures may have alternating ridges 28 and grooves 29 that extend about the circumference of the cylinder, which is typically the result of the perimeter wall being formed of a corrugated material such as steel. Other types of structures, such as conventional roadway signs or billboards, may also form the structure upon which other elements of the system may be utilized. Further, the structures contemplated in this disclosure are not necessarily limited to those structures which are stationary in character, and could comprise moving structures such as, for example, trucks, trains, ships and other movable structures with relatively broad substantially vertical surfaces.

Another aspect of the disclosure is a display apparatus 30 which may be utilized in combination with, or independent of, the structure 20. When utilizing the combination, the display apparatus 30 may be mounted on the structure, such as on the perimeter wall 24, and may be positioned adjacent to or on the exterior surface 22 of the structure. Typically, the display apparatus 30 may occupy the exterior surface to a variety of different extents, and a large portion of the exterior surface 22 may be covered, although the portion may not extend over a majority portion of the exterior surface.

In the illustrative embodiments, the display apparatus may include a housing 32 which may enclose the interior 34 of the housing. A slot 36 may extend between the interior and the exterior of the housing. The housing may be elongated along a longitudinal axis 37 which extends between opposite ends 38, 39 of the housing. Typically, the longitudinal axis 37 may be oriented substantially vertical when the housing is mounted on the structure for use, although other embodiments had may have the axis 37 oriented substantially horizontally or at various degrees of inclination between the horizontal and the vertical.

The housing 32 may include a tubular sleeve 40 which defines the interior of the housing and may be elongated between the opposite ends 38, 39 of the housing. The slot 36 may extend through the tubular sleeve 40 into the interior. In some embodiments, the effective length of the housing may be increased through the use of a plurality of sleeve portions 42, 44 to form the tubular sleeve 40. The sleeve portions may be arranged along the longitudinal axis 37 to provide an effective length for the sleeve 40 that is greater than would be practical in a sleeve formed of a single piece or part. In those embodiments in which more than one sleeve portion is employed, a joiner element 46 may be positioned between adjacent sleeve portions to join the sleeve portions together in alignment and provide a degree of weather tightness to the juncture of the sleeve portions.

The housing 32 may further include at least one end cap 50 which is located at an end of the housing, and typically a pair of end caps may be utilized with each of the end caps be located at one of the ends of the housing to close the ends of the tubular sleeve and to provide a degree of weather tightness to the housing. In some embodiments, each end cap may include a mounting element 52 for abutting against the structure and providing a mounting means for mounting the housing as well as other aspects of the display apparatus to the structure. Illustratively, the mounting structure 52 may include at least one ear 54 and optionally a pair of ears 54, 55 which extend in substantially opposite directions. Each ear may be adapted for attachment to the structure, such as by having a hole for receiving a fastener to pass through the ear and into the perimeter wall of the structure. Other means of attachment may also be utilized.

The display apparatus 30 may further include a display member 60 which is mounted on the housing 32 and may be movable with respect to the housing between a retracted condition (see FIGS. 2, 3, 5, 6, 12, 13, and 14) and an extended condition (see FIGS. 1, 4, 7, 8, 9, 13, and 14). In the retracted condition, the display member 60 may be positioned in the interior of the housing (such as in a spooled configuration) and in the extended condition may be extended through the slot 36 of the housing such that a large portion of the display member is external to the housing. The display member 60 may be formed of a sheet material which may exhibit a degree of flexibility to permit the material to be coiled in the interior of the housing when in the retracted condition, but also may permit the display member to conform to some degree to the shape of the exterior surface of the structure when the display member is extended from the housing.

The display member 60 may have an outboard end 62 which moves away from the housing as the display member is moved from the retracted condition to the extended condition. The display member 60 may have any suitable length. Illustratively, the display member 60 may have a length ranging from approximately 10 feet (approximately 3 m) to approximately 40 feet (approximately 12 m), with a length in the range from approximately 20 feet (approximately 6 m) to approximately 30 feet (approximately 9 m) being highly useful. The material forming the display member 60 may be suitably flexible to generally conform to any curvature in the exterior surface 22 of the structure. Resistance to stretching or elongation of the material is also desirable in order to be able to maintain a desired degree of tension in the display member over a period of time to resist sagging. One illustrative suitable material for the display member is sold under the tradename UltraMesh® Blockout—12.5 oz. sold by UltraFlex Systems Incorporated of Riverview, Fla. 33578.

The display member 60 may have opposite lateral side edges 64, 65 and an outboard edge 66 located at the outboard end 62. Embodiments of the display member may include two or more portions or segments (see FIGS. 8 and 9) to produce a larger display member with greater display area. The segments of the display member may be attached together in any suitable manner, such as continuous attachments or a plurality of discrete attachments (see FIG. 9).

In some embodiments, the display member 60 may also include a stiffener member 68 which is attached to the sheet material at the outboard end 62 of the display member and which may be attached to the structure in addition to the housing in order to provide support to the display member in the extended condition adjacent to the structure. Additionally, or alternatively, the member 68 may function as a handle or a grip on the outboard end 62 which facilitates pulling withdrawal of the display member from the housing into the extended condition and may also help prevent the outboard end from unintentionally being retracted fully into the interior of the housing.

The display apparatus 30 may also include a support assembly 70 which may be positioned in the housing and may have at least a portion of the display member 60 wrapped thereabout in the retracted condition of the member 60. Illustratively, the support assembly 70 may include a support shaft 72 which extends longitudinally in the interior of the housing, and the support shaft may be positioned inside the tubular sleeve in the interior of the housing. The support shaft 72 may be rotatably mounted on the housing, such as on the end caps thereof to permit rotation of the shaft as the display member moves between the retracted and extended conditions. The support shaft may also have opposite end portions 74. An inboard end of the display member 60 may be secured to the support shaft 72 in any suitable manner in order to permit spooling or wrapping of at least a portion of the display member about the shaft, and optionally the securement may be releasable to permit replacement of the display member as desired. Sufficient space may be provided in the interior 34 of the housing to permit substantially the entirety of the length of the display member to be spooled about the support shaft in the retracted condition.

In some embodiments, the rotation of the support shaft may be biased towards retracting the display member into the housing. In some optional embodiments, a ratchet apparatus 76 may be provided to secure the display member at a selected degree of extension of the display member from the interior of the housing and effectively resist the retracting bias imposed on the display member. Illustratively, the ratchet apparatus 76 may include a ratchet gear 78 which is mounted on the support shaft, such as on one of the end portions 74 of the shaft. The ratchet gear may include a plurality of teeth 80. The ratchet apparatus 76 may also include a ratchet pawl 82 which is mounted on the housing and engages the ratchet gear to permit rotation of the ratchet gear with respect to the pawl in a first rotational direction but resists rotation of the ratchet gear with respect to the ratchet and pawl in a second (and opposite) rotational direction when the pawl is in the in engaged position or condition with respect to the ratchet gear. The ratchet pawl may be movable or rotatable from the engaged position to a release position with respect to the ratchet gear in which the pawl 82 no longer resists rotation of the ratchet gear. A release actuator 84 may be mounted on the housing and may engage the ratchet pawl in a manner such that when the release actuator is actuated (for example, depressed) the ratchet pawl may be moved from the engaged position to the release position.

The support assembly 70 may also include a biasing apparatus 86 which is configured to apply a tension force to the display member 60 which tends to bias the display member toward the retracted condition in the interior 34 of the housing 32. The biasing apparatus 86 may be configured to apply a rotational force or torque to the support shaft 72 such that support shaft is biased to rotate in a direction that tends to retract or pull the display member into the retracted condition in the housing. Illustratively, the biasing apparatus 86 may comprise a torsion spring configured to apply a torsion force to the support shaft with respect to the housing 32. Optionally, other means for retracting the display member and/or applying tension to the display member may also be utilized, such as a crank assembly engaged with the support shaft to rotate the support shaft.

The support assembly 70 may also include at least one support strand 90 which extends along at least a portion of the length of the display member 60. The support strand 90 may be located at one of the lateral side edges 64, 65 of the display member. In the illustrative embodiments, a pair of the support strands 90, 92 is utilized with each of the support strands being located adjacent to one of the lateral side edges of the display member. Each of the support strands may be united with the display member along a respective one of the lateral side edges. Optionally, the support strands may extend along the side edges 64, 65 without being connected to the display member along those edges. Each of the support strands 90, 92 may extend from the outboard end 62 of the display member toward the housing 32 of the display apparatus, and each may be mounted to the stiffener member 68 at laterally spaced locations on the member 68. Each of the support strands may have a distal end 94, and an exterior of the distal end of the support strands may be threaded with a nut 96 being threaded on the threads. In the illustrative embodiments, each of the support strands may be formed of a cable or cord with suitable flexibility to follow the curve (if any) of the exterior surface 22 of the structure, and may also have suitable resistance to stretching or elongation in order to be able to maintain tension in the strand. Other materials may be utilized for the support strands, such as, for example, straps of woven fiber with suitable strength and elongation characteristics.

The support assembly 70 may also include at least one support element 100 which is configured to mount the support strand to the structure 20 to thereby support at least a portion of the display member on the structure. In some embodiments, the support element may also be utilized to mount the housing 32 on the perimeter wall. Typically, a pair of the support elements 100, 102 may be utilized with each of the support elements being associated with a respective support strand. The support elements 100 may be utilized to support end portions of the support strand, and optionally additional support elements may be positioned at locations in between the outboard end 62 and the housing 32 to provide additional points of support to the support strand.

In the illustrative embodiments, each of the support elements 100, 102 may include an inner portion 104 for positioning adjacent to the exterior surface of the perimeter wall of the structure. The inner portion 104 may have an inner surface 106 which is configured to abut against and may contact the exterior surface of the structure. The inner surface may have a shape that is complementary to the shape of the exterior surface of the structure, and illustratively may have a corrugated shape which is configured to engage the ridges 28 and grooves 29 of the corrugations of the exterior surface of the perimeter wall. The inner portion 104 may also form a pocket structure. The inner portion of each support element may include a base 110 for positioning against the exterior surface of the perimeter wall of the structure. The base 110 may define a hole 112 which is configured to receive a fastener which may fasten the inner portion to the perimeter wall the structure. Illustratively, the fastener may comprise a bolt that passes through the hole 112 as well as a hole formed in the perimeter wall of the structure, and a nut may be positioned on the bolt at a location adjacent to the interior surface of the perimeter wall of the structure to effectively secure the inner portion to the perimeter wall. The inner portion 104 may also include a pair of pocket walls 116, 118 which extend from the base 110 to define the pocket with the base. Each of the pocket walls 116, 118 may extend outwardly from the base and may also extend centrally inward to form the pocket. A slot 120 may be defined between the pocket walls to receive a portion of the support strand 90.

Each support element 100, 102 may also include an outer portion 124 which may be configured to removably mount on the inner portion 104 of the support element. The outer portion 124 may be removably positionable in the pocket formed by the inner portion such that the outer portion may have a mounted condition in which the outer portion is positioned in the pocket, and a dismounted condition in which the outer portion is removed from the pocket. The outer portion may also define a channel 126 which is configured to receive a portion of the support strand 90.

In an implementation of the disclosure, the inner portion 104 of the support elements may be mounted on or otherwise secured to the perimeter wall of the structure 20. The support elements may be mounted in locations suitable for mounting the housing 32 to the perimeter wall, as well as in locations which are suitable for securing the extended display member to the perimeter wall. For example, the inner portions of the respective support elements may be mounted to the perimeter wall at locations generally corresponding to the positions of the distal ends 94 of the support strands 90, 92 when the display member is in the extended condition. The outer portions 124 of the support elements 100, 102 may each be mounted on the distal ends of the respective strands 90, 92 by inserting a portion of the strand through the channel 126 in the outer portion 124 and (optionally) positioning a nut 96 on the distal end to retain the outer portion 124 on the respective strand.

Once the housing has been suitably mounted on the perimeter wall, the display member may be at least partially withdrawn from the interior of the housing and out toward the retracted condition toward the extended condition. The outer portions 124 of the respective support elements 100, 102 may be positioned in the respective pockets of the inner portions 104 of the support elements 100, 102 by positioning a portion of the respective strand in the slot 120 of the respective support element such that the outer portion is positioned in the pocket and thus resists movement of the strand, as well as the display member, back toward the housing 32. Tension in the strands 90, 92, as well as the display member 60, may be adjusted by adjusting the position of the nut 96 on the threaded distal end 94 of the support strand by rotation of the nut with respect to the strand.

Advantageously, the display apparatus of the disclosure may provide a solution that is substantially self-contained prior to installation and deployment of the apparatus on a structure.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system for displaying information in a large scale format, the system comprising:

a structure extending upwardly with respect to a ground surface, the structure having an exterior surface;

a display apparatus mounted on the structure, the display apparatus comprising:

a housing being elongated in a longitudinal direction, the housing having an interior, the housing including a primary tubular sleeve defining at least a portion of the interior, the primary tubular sleeve having a length defined between opposite ends of the primary tubular sleeve, the housing having a longitudinally-oriented slot being formed in the primary tubular sleeve;

a display member mounted on the housing and being movable through the slot with respect to the housing between a retracted condition and an extended condition, the display member having a width measured in the longitudinal direction of the housing and a length measured perpendicular to the longitudinal direction of the housing, the display member being formed of a sheet material with markings on the sheet material, the markings being visible when the display member is in the extended condition on the structure and being hidden when the display member is in the retracted condition;

wherein the display apparatus is extendable in the longitudinal direction by attachment of at least one additional tubular sleeve to a said end of the housing to further elongate the housing in the longitudinal direction for accommodating a said display member with a width greater than the length of the primary tubular sleeve.

2. The system of claim 1 wherein the display member is formed of a flexible material with at least a portion of the display member being spooled in the interior of the housing member; and wherein the display member is substantially entirely positioned in the interior of the housing when the display member is in the retracted condition and the display member is substantially entirely positioned outside of the interior of the housing when the display member is in the extended condition.

3. The system of claim 1 wherein the housing of the display apparatus includes a joiner element positioned between the primary tubular sleeve and the at least one additional tubular sleeve to join the tubular sleeves together as a unit with a common interior.

4. The system of claim 1 wherein the sheet material of the display member is formed of a flexible material, and the display member includes a stiffener member attached to the sheet material at an outboard end of the display member positioned opposite of the housing when the display member in in the extended condition.

5. The system of claim 4 wherein an aperture for receiving a portion of a human hand is formed in the stiffener member such that the stiffener member functions as a handle.

6. The system of claim 1 wherein the display apparatus includes a support assembly for supporting the display member in the housing, the support assembly including a support shaft in the interior of the housing with a portion of the display member wrapped thereabout, the support assembly including a biasing apparatus configured to apply a tension force to the display member via the support shaft to bias the display member toward the retracted condition.

7. The system of claim 6 wherein the support assembly of the display apparatus includes a ratchet apparatus configured to secure a selected degree of extension of the display member from the housing against the bias applied by the biasing apparatus.

8. The system of claim 6 wherein the support assembly of the display apparatus includes at least one support strand extending along at least a portion of the display member, the support strand being located at a lateral side edge of the sheet material of the display member.

9. The system of claim 8 wherein the support assembly of the display apparatus includes a pair of the support strands with each said support strand being located adjacent to one of the lateral side edges of the display member.

10. The system of claim 8 wherein the at least one support strand is united with the lateral side edge of the display member.

11. The system of claim 8 wherein the support assembly of the display apparatus includes at least one support element configured to attach the support strand to the structure to thereby support a portion of the display member on the structure.

12. The system of claim 1 wherein the display member includes a stiffener member attached to the sheet material at an outboard end of the display member positioned opposite of the housing when the display member in in the extended condition; and wherein a pair of support strands extend along at least a portion of the display member, the support strands being located at opposite lateral side edges of the sheet material of the display member and extending between the housing and the stiffener member such that the support strands are uncoiled from the interior of the housing with the sheet material of the display member as the display member is moved from the retracted condition to the extended condition.

13. The system of claim 1 wherein the display member has opposite lateral side edges extending between inboard and outboard ends of the display member; and wherein the display member is a continuous piece of sheet material from one said lateral side edge to the opposite said lateral side edge.

14. The system of claim 1 wherein the display member has opposite lateral side edges extending between inboard and outboard ends of the display member; and wherein the display member comprises two or more segments extending in a length direction of the display member between the inboard and outboard ends of the display member to increase the width of the display member.

15. The system of claim 14 wherein the display member has opposite lateral side edges extending between inboard and outboard ends of the display member; and wherein the segments of the display are attached together along inner lateral edges of the two or more segments.

16. A system for displaying information in a large scale format, the system comprising:

a structure extending upwardly with respect to a ground surface, the structure having an exterior surface;

a display apparatus mounted on the structure, the display apparatus comprising:

a housing having an interior;

a display member mounted on the housing and being movable with respect to the housing between a retracted condition and an extended condition, the display member being formed of a sheet material with markings on the sheet material, the markings being visible when the display member is in the extended condition on the structure and being hidden when the display member is in the retracted condition;

wherein the structure comprises an agricultural storage bin having a perimeter wall with a top and a bottom located at the ground surface, the display apparatus being mounted on the exterior surface between the top and bottom of the perimeter wall.

17. The system of claim 16 wherein the exterior surface of the structure has a substantially cylindrical shape with alternating ridges and grooves oriented in substantially horizontal planes.

18. A system for displaying information in a large scale format, the system comprising:

a structure extending upwardly with respect to a ground surface, the structure having an exterior surface;

a display apparatus mounted on the structure, the display apparatus comprising:

a housing having an interior;

a display member mounted on the housing and being movable with respect to the housing between a retracted condition and an extended condition, the display member being formed of a sheet material with markings on the sheet material, the markings being visible when the display member is in the extended condition on the structure and being hidden when the display member is in the retracted condition;

wherein the display apparatus includes a support assembly for supporting the display member in the housing, the support assembly including a support shaft in the interior of the housing with a portion of the display member wrapped thereabout, the support assembly including a biasing apparatus configured to apply a tension force to the display member via the support shaft to bias the display member toward the retracted condition;

wherein the support assembly of the display apparatus includes at least one support strand extending along at least a portion of the display member, the support strand being located at a lateral side edge of the sheet material of the display member;

wherein the support assembly of the display apparatus includes at least one support element configured to attach the support strand to the structure to thereby support a portion of the display member on the structure;

wherein the at least one support element comprises:

an inner portion mounted on the exterior surface of the structure and forming a pocket; and an outer portion mounted on the at least one support strand and being removably mountable on the inner portion of the support element, the outer portion having a mounted condition in which the outer portion is at least partially positioned in the pocket of the inner portion and a dismounted condition in which the outer portion is removed from the pocket of the inner portion.

19. The system of claim 18 wherein the outer portion of the at least one support element defines a channel configured to receive a portion of the support strand to mount the outer portion on the at least one strand.

20. The system of claim 18 wherein the inner portion of the at least one support element includes:

a base for positioning against the exterior surface of the perimeter wall of the structure, the base defining a hole configured to receive a fastener to fasten the base of the inner portion to a perimeter wall of the structure; and a pair of pocket walls extending from the base to define the pocket with the base, each of the pocket walls extending outwardly from the base and extending inwardly to form the pocket, a slot being defined between the pocket walls for receiving a portion of the at least one support strand when the outer portion is in the mounted condition on the inner portion.

* * * * *